US011564025B2

(12) United States Patent
Blundell et al.

(10) Patent No.: US 11,564,025 B2
(45) Date of Patent: Jan. 24, 2023

(54) EARPLUG WITH WIRELESS AUDIO COMMUNICATION

(71) Applicant: Gentex Corporation, Simpson, PA (US)

(72) Inventors: Michael Pearson Blundell, Windham, NH (US); Christopher Hudson, Bedford, NH (US); Zoltan S. Brutler, Groton, MA (US)

(73) Assignee: GENTEX CORPORATION, Simpson, PA (US)

( * ) Notice: Subject to any disclaimer, the term of this patent is extended or adjusted under 35 U.S.C. 154(b) by 0 days.

(21) Appl. No.: 17/272,051

(22) PCT Filed: Sep. 4, 2019

(86) PCT No.: PCT/US2019/049515
§ 371 (c)(1),
(2) Date: Feb. 26, 2021

(87) PCT Pub. No.: WO2020/051210
PCT Pub. Date: Mar. 12, 2020

(65) Prior Publication Data

US 2021/0352396 A1 Nov. 11, 2021

Related U.S. Application Data

(60) Provisional application No. 62/727,327, filed on Sep. 5, 2018.

(51) Int. Cl.
*H04R 1/10* (2006.01)
*H04R 1/34* (2006.01)
*H04R 1/44* (2006.01)

(52) U.S. Cl.
CPC ..... *H04R 1/1016* (2013.01); *H04R 1/1075* (2013.01); *H04R 1/345* (2013.01);
(Continued)

(58) Field of Classification Search
CPC .... H04R 1/086; H04R 1/1016; H04R 1/1075; H04R 25/604
See application file for complete search history.

(56) References Cited

U.S. PATENT DOCUMENTS 7,532,733 B2 * 5/2009 Saltykov ..... H04R 25/456 381/322
8,462,971 B2 * 6/2013 Gommel ..... H04R 25/652 381/322

(Continued)

FOREIGN PATENT DOCUMENTS

CN 101161032 A 4/2008
WO WO-9507014 A1 * 3/1995 ..... H04R 25/604
WO 2018128577 A2 7/2018

OTHER PUBLICATIONS

International Search Report and Written Opinion dated Dec. 2, 2019 for International Patent Application No. PCT/US2019/049515, 8 pages.

(Continued)

*Primary Examiner* — Ryan Robinson
(74) *Attorney, Agent, or Firm* — Morgan, Lewis & Bockius LLP

(57) ABSTRACT

An earplug includes a housing and a receiver positioned in the housing. The receiver may be configured to receive a wireless audio signal from an audio source external to the earplug and convert the wireless audio signal to an electrical audio signal. The earplug may include a speaker configured to receive electrical audio signal from the receiver and convert the electrical audio signal into audible sound output from a speaker port. The earplug may include a projection including an opening that defines at least a portion of a sound channel from the speaker. The projection may receive the audible sound output from the speaker and output the audible sound out of the earplug. The earplug may include
(Continued)

earplug padding configured to form a seal with a user's ear canal. The earplug may include an acoustic vent positioned in the sound channel, including a waterproof membrane extending across the channel.

19 Claims, 8 Drawing Sheets

(52) U.S. Cl.
CPC ..... *H04R 1/44* (2013.01); *H04R 2420/07* (2013.01); *H04R 2460/11* (2013.01)

(56) References Cited

U.S. PATENT DOCUMENTS 8,737,665 B2 * 5/2014 Chung ..... H04R 1/1016 381/372
8,744,111 B2 * 6/2014 Chu ..... H04R 1/1091 381/373
9,398,365 B2 * 7/2016 Liu ..... H01R 13/622
9,510,076 B2 * 11/2016 Lee ..... H04R 1/1066
9,532,128 B2 * 12/2016 Linden ..... H02J 7/0044
9,654,860 B2 * 5/2017 Shin ..... H04R 1/1016
9,838,771 B1 12/2017 Masaki et al.
9,866,940 B2 * 1/2018 Walker ..... H04R 1/1075
10,440,459 B2 * 10/2019 Smith ..... H04M 1/05
10,735,855 B2 * 8/2020 Zhang ..... H04R 1/1058
10,827,249 B1 * 11/2020 Pine ..... H04R 1/1025
10,841,683 B2 * 11/2020 Trainer ..... G10K 11/17873
10,966,012 B2 * 3/2021 Linden ..... H02J 7/0044
2013/0294634 A1 * 11/2013 Chen ..... H04R 1/1066 381/380
2015/0110320 A1 4/2015 Liu et al.
2016/0100240 A1 * 4/2016 Matsuo ..... H04R 1/1033 381/380
2017/0094386 A1 3/2017 Trainer et al.
2018/0035192 A1 2/2018 Houle
2018/0070165 A1 3/2018 Hatfield et al.
2020/0288251 A1 * 9/2020 Kuipers ..... H04R 25/456
2021/0099786 A1 * 4/2021 Sasaki ..... H04R 1/1075
2021/0321188 A1 * 10/2021 Kurihara ..... H01H 13/50

OTHER PUBLICATIONS

Extended European Search Report issued in corresponding European Application No. 19858322; dated May 10, 2022.

* cited by examiner

EARPLUG WITH WIRELESS AUDIO COMMUNICATION

CROSS REFERENCE TO RELATED APPLICATIONS

This application is a U.S. National Phase of International Application No. PCT/US2019/049515 filed on Sep. 4, 2019, which claims the benefit of U.S. Provisional Patent Application No. 62/727,327 filed Sep. 5, 2018 entitled "Waterproof Earplug with Wireless and Audio Communication", each of which is incorporated by reference herein in its entirety.

FIELD OF INVENTION

The present invention generally relates to earplugs and, more particularly in some embodiments, to an earplug with wireless audio communication capabilities.

BRIEF SUMMARY OF THE INVENTION

In one embodiment, there is an earplug that includes: a housing and a receiver positioned in the housing, the receiver configured to receive a wireless audio signal from an audio source external to the earplug and convert the wireless audio signal to an electrical audio signal; a speaker positioned in the housing and configured to receive the electrical audio signal from the receiver and convert the electrical audio signal into audible sound output from a speaker port of the speaker; a projection extending from the housing and including an opening that defines at least a portion of a sound channel from the speaker, the projection being configured to receive the audible sound output from the speaker and output the audible sound out of the earplug; earplug padding extending over the projection and configured to form a seal with the user's ear canal; an acoustic vent positioned in the sound channel, the acoustic vent being acoustically transmissive, the acoustic vent including a waterproof membrane extending across the channel.

The projection of the earplug may be oriented at a predetermined angle relative to a bottom surface of the housing. In one embodiment, the predetermined angle may be between 5 degrees and 20 degrees. In another embodiment, the predetermined angle is between 10 degrees and 15 degrees. The predetermined angle may be approximately 12 degrees.

In a further embodiment, the earplug includes a sound path seal that extends from the speaker to the acoustic vent, the sound path seal including an opening that defines at least a portion of the sound channel from the speaker. In one embodiment, the sound path seal extends about a periphery of the speaker port to create a waterproof seal at the speaker.

In a further embodiment, the membrane of the acoustic vent is dimensioned to fit the opening of the projection, forming a waterproof seal. In a further embodiment, the receiver of the earplug is a receiver coil. In a further embodiment, a length of the projection is greater than a diameter of the projection. In a further embodiment, the projection tapers toward the distal end. In a further embodiment, the membrane is comprised of polytetrafluoroethylene (PTFE) or expanded polytetrafluoroethylene (ePTFE). In a further embodiment, the earplug padding tapers toward the distal end. In a further embodiment, a length of the earplug padding is greater than a diameter of the earplug padding. In a further embodiment, the earplug padding is comprised of a compliant, elastomeric and/or deformable material. In a further embodiment, the membrane repels water to protect the earplug against immersion up to at least IP68 standards.

In one embodiment, there is an earplug that includes: a housing and a receiver positioned in the housing, the receiver configured to receive a wireless audio signal from an audio source external to the wireless earplug and convert the wireless audio signal to an electrical audio signal; a speaker may be positioned in the housing and configured to receive the electrical audio signal from the receiver and convert the electrical audio signal into audible sound output from a speaker port of the speaker; a projection extending from the housing, the projection including an opening that defines at least a portion of a sound channel from the speaker, the projection being configured to receive the audible sound output from the speaker and output the audible sound out of the earplug, the projection oriented at a predetermined angle relative to a bottom surface of the housing, a length of the projection may be greater than a diameter of the projection, an earplug padding extending over the projection and configured to form a seal with a user's ear canal, the length of the earplug padding may be greater than a diameter of the earplug padding, the earplug padding tapering toward the distal end; an acoustic vent positioned in the sound channel, the acoustic vent being acoustically transmissive and including a waterproof membrane to restrict water from contacting the speaker, the waterproof membrane of the acoustic vent dimensioned to fit the opening of the projection, forming a waterproof seal; a sound path seal that extends from the speaker to the acoustic vent, the sound path seal including an opening that defines at least a portion of the sound channel from the speaker, the sound path seal extending about a periphery of the speaker port to create a waterproof seal at the speaker.

BRIEF DESCRIPTION OF THE SEVERAL VIEWS OF THE DRAWINGS

The following detailed description of embodiments of the invention will be better understood when read in conjunction with the appended drawings of an exemplary embodiment. It should be understood, however, that the invention is not limited to the precise arrangements and instrumentalities shown.

In the drawings.

DETAILED DESCRIPTION OF THE EXEMPLARY EMBODIMENTS OF THE INVENTION

Figure 1:
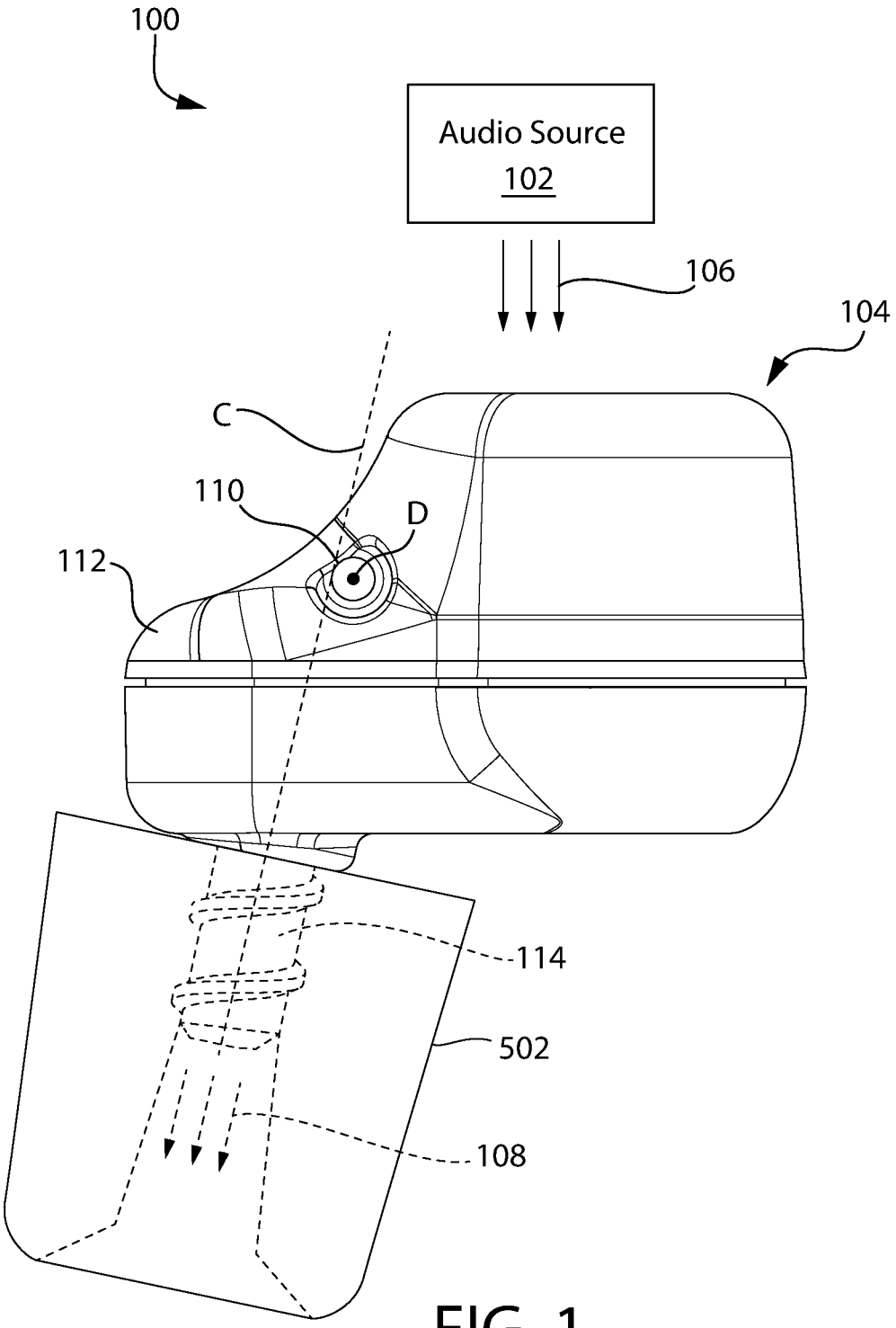
FIG. 1 is a side view of an earplug in a wireless communication system according to an exemplary embodiment of the invention.

Referring to the drawings in detail, wherein like reference numerals indicate like elements throughout, there is shown in FIGS. 1-8, an earplug, generally designated 104, for use in a wireless communication system, generally designated 100, in accordance with an exemplary embodiment of the present invention.

As used herein, an earplug (may also be referred to herein as an "earbud") may be a device that can be inserted into the ear canal of a user to protect the user's ear from external noises and/or the intrusion of water, foreign bodies, dust and/or wind. The earplug may also be configured with a speaker to output sound in the ear canal of the user when an audio signal is received by the speaker.

In some embodiments, the earplug communicates wirelessly with one or more audio sources. By using an earplug with wireless communication capabilities, there is no need for cumbersome audio signal wiring from the audio source because the audio signal is transmitted wirelessly from the audio source to the wireless earplug. In some embodiments, the earplug is ergonomically dimensioned to improve comfort for the user while the earplug is positioned in the ear of the user. In some embodiments, the earplug is waterproof. As used herein, waterproof means to protect the earplug against immersion in water up to at least IP68 standards. In some embodiments, the earplug is at least substantially waterproof such that the earplug is capable of producing sound even if the earplug has been exposed to water or moisture from immersion or sweat of the user.

Referring to FIG. 1, the wireless communication system 100 includes an audio source 102. The audio source 102 may be configured to transmit a wireless audio signal 106 to the earplug 104 while the earplug 104 is positioned in the ear of the user. The wireless audio signal 106 may be any signal representative of sound transmitted wirelessly. The audio source may be positioned at or near the earplug 104 during use. In one embodiment, the audio source 102 is transmitted from a headset (not shown) such as over-ear cups worn by the user. The audio source 102 may include a transmitter coil that transmits the wireless audio signal 106 using near-field magnetic induction (NFMI). Using NFMI, the audio source 102, via the transmitter coil, may generate a magnetic field to transmit the wireless audio signal 106.

The earplug 104 may be configured to receive the wireless audio signal 106 and produce audible sound 108 out of a projection 114, using one or more audio components described herein, while the projection 114 is at least partially inserted into the ear canal of the user. As discussed in further detail below, the projection 114 couples to an earplug padding or earplug seal to provide protection to the ear canal such as sound attenuation while allowing desirable sound to be transmitted to the ear through the projection 114.

In some embodiments, the earplug 104 includes a housing 112. The housing may be water tight, waterproof, or at least water resistant to prevent water from entering an inner compartment of the housing 112 and damaging the audio components of the earplug 104.

Figure 2:
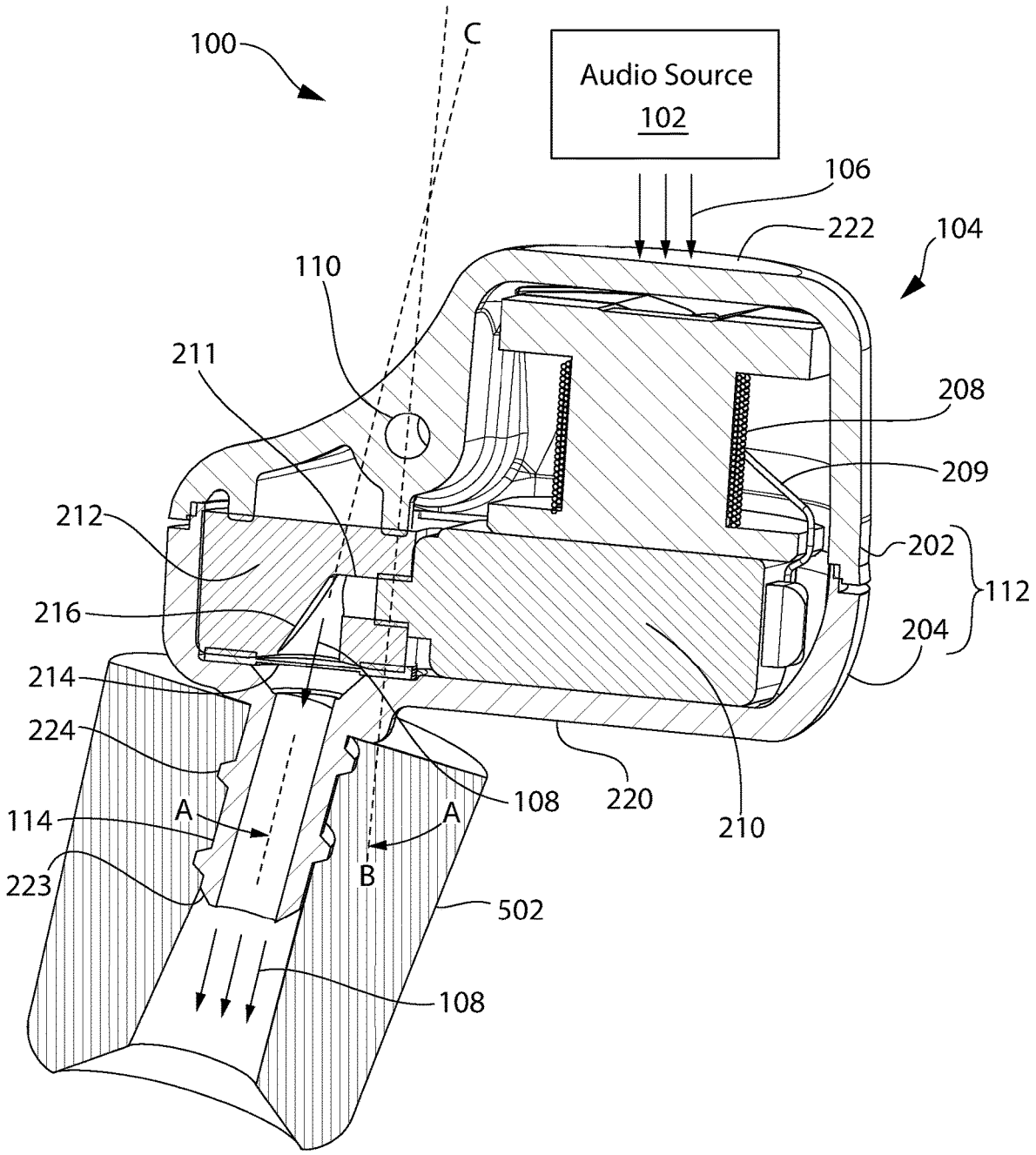
FIG. 2 is a side cross sectional view of the earplug of FIG. 1.

Referring to FIG. 2, the earplug 104 may include a housing 112, a receiver coil 208, electrical audio signal wiring 209, a speaker 210, a sound path seal 212, an acoustic vent 214, and/or projection 114. The housing 112 may include a top housing 202 and a bottom housing 204. The top housing 202 and bottom housing 204 may be coupled together to define an inner compartment. When coupled, the top housing 202 and bottom housing 204 may form a waterproof seal to prevent water from entering the inner compartment. In some embodiments, the top housing 202 and the bottom housing 204 are welded or molded together to form an outer housing of one piece or a single piece. For example, the top housing 202 and the bottom housing 204 may be coupled together using an ultrasonic welding process and/or a shear weld joint design. In one embodiment, the top housing 202 and the bottom housing 204 are coupled together using an adhesive or epoxy. The use of the weld and/or epoxy to couple the perimeter of the top housing 202 and bottom housing 204 to form the unity outer housing may help ensure that the inner compartment is watertight sealed or waterproof from the environment. In other embodiments, the top housing 202 and the bottom housing 204 may be formed around the inner compartment as a unitary structure such as through a co-molding or additive manufacturing (3D printing) process.

The receiver coil 208 may be configured to receive, using NFMI, the wireless audio signal 106 transferred via the magnetic field generated by the audio source 102 and convert the wireless audio signal 106 into an electrical audio signal. The receiver coil 208 may have about 143 turns. The receiver coil may have a resistance of about 10.5 Ohms DC. The receiver coil may have an inductance of about 2.5 mH at about 1 kHz. In some embodiments, instead of a receiver coil 208 and NFMI, other wireless communication methodologies are used, such as radio frequency communication. In some embodiments, the receiver coil 208 may be a receiver configured to receive wireless audio signals using wireless methodologies other than NFMI, such as radio frequency (RF) methodologies.

The speaker 210 may be electrically coupled to the receiver coil 208. The speaker 210 may be configured to receive the electrical audio signal via electrical audio signal wiring 209 and convert the electrical audio signal into audible sound 108. The speaker 210 may output the audio sound 108 through a speaker port 211. The audible sound 108 may travel through the sound channel 216 (that may extend through the earplug projection 114) to the ear of the user. The speaker 210 may passively generate sound, without the use of a battery, using power from the electrical audio signal.

With continued reference to FIG. 2, the sound path seal 212 may extend from speaker port 211 of the speaker 210 to the acoustic vent 214. In one embodiment, the speaker port 211 is about 0.05 inches in diameter. In one embodiment, the speaker port 211 is about 0.01 inches to about 0.07 inches in diameter. The sound path seal 212 may be in direct contact with the speaker port 211 and the acoustic vent 214. The sound path seal 212 may include an inner channel that, along with an opening the projection 114, may define the sound channel 216 for the audible sound 108 to travel from the speaker 210 through a lateral end of the projection 114. The inner channel of the sound path seal 212 may have a predetermined dimension to define the sound channel 216 and to minimize acoustic loss. In some embodiments, the dimension of the opening in the sound path seal 212 at the speaker 210 is about 0.045 inches internal diameter. In some embodiments, the dimension of the opening in sound path seal 212 at the acoustic vent 214 is about 0.070 inches internal diameter. In one embodiment, the dimension of the opening in sound path seal 212 at the acoustic vent 214 is between about 0.01 inches internal diameter to about 0.09 inches internal diameter. The opening in the sound path seal 212 at the speaker 210 and the opening in the sound path seal 212 at the acoustic vent 214 may be oriented at an angle of about sixty (60) degrees relative to each other. In one embodiment, the opening in the sound path seal 212 at the speaker 210 and the opening in the sound path seal 212 at the acoustic vent 214 is oriented at an angle of 61.4 degrees relative to each other. In one embodiment, the opening in the sound path seal 212 at the speaker 210 and the opening in the sound path seal 212 at the acoustic vent 214 may be oriented at an angle between fifty (50) to sixty (60) degrees relative to each other.

The sound path seal 212, along with the acoustic vent 214, may provide a waterproof seal to prevent audio components of the earplug 104 (e.g., speaker 210, receive coil 208, and/or electrical audio signal wiring 209) from exposure to water. For example, the sound path seal 212 may extend about a periphery of the speaker port 211 to create a waterproof seal at speaker port 211. In one embodiment, the sound path seal 212 may extend about a portion of the periphery of the speaker port 211 to create a waterproof seal at speaker port 211. The sound path seal 212 may be a flexible material, such as an elastomer material. The sound path seal 212 may be a flexible material, including materials that mimic the properties of an elastomer material. Examples of the elastomer material may include silicone, viton, buna-N and other materials with similar properties. In some embodiments, a waterproof membrane may be wrapped around audio components of the earplug 104 (e.g., e.g., speaker 210, receive coil 208, and/or electrical audio signal wiring 209) to prevent, or at least limit, exposure to water.

The acoustic vent 214 may be positioned at any position in the sound channel 216 between the speaker port 211 of the speaker 210 and an outlet of projection 114. For example, as shown in FIG. 2, the acoustic vent 214 may be positioned at a bottom wall 220 of the bottom housing 204 near the inlet to the projection 114. In one embodiment, the speaker port 211 is cylindrical. In one embodiment, the sound path 216 is conical in shape. The sound channel 216 may have a slanted conical shape such that the axis C generally extends through the center of the sound channel 216. In embodiment, the speaker port extends from the side of the sound channel 216 proximate the tip.

Figure 3:
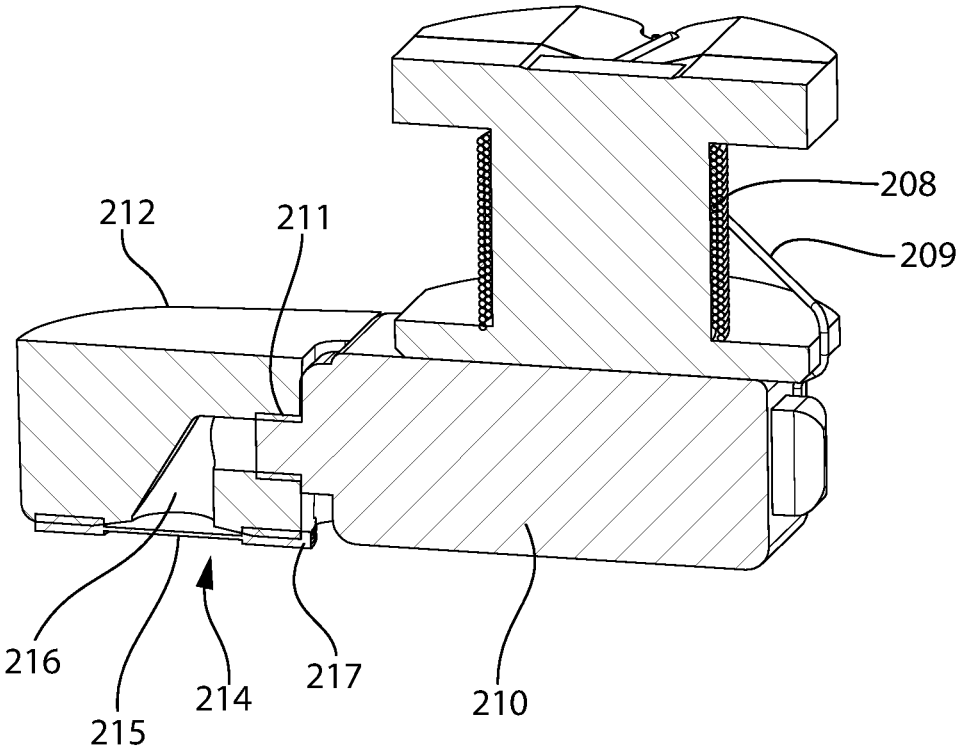
FIG. 3 is a cross sectional perspective side view of the internal components of the earplug of FIG. 2 with the housing removed.
Figure 4:
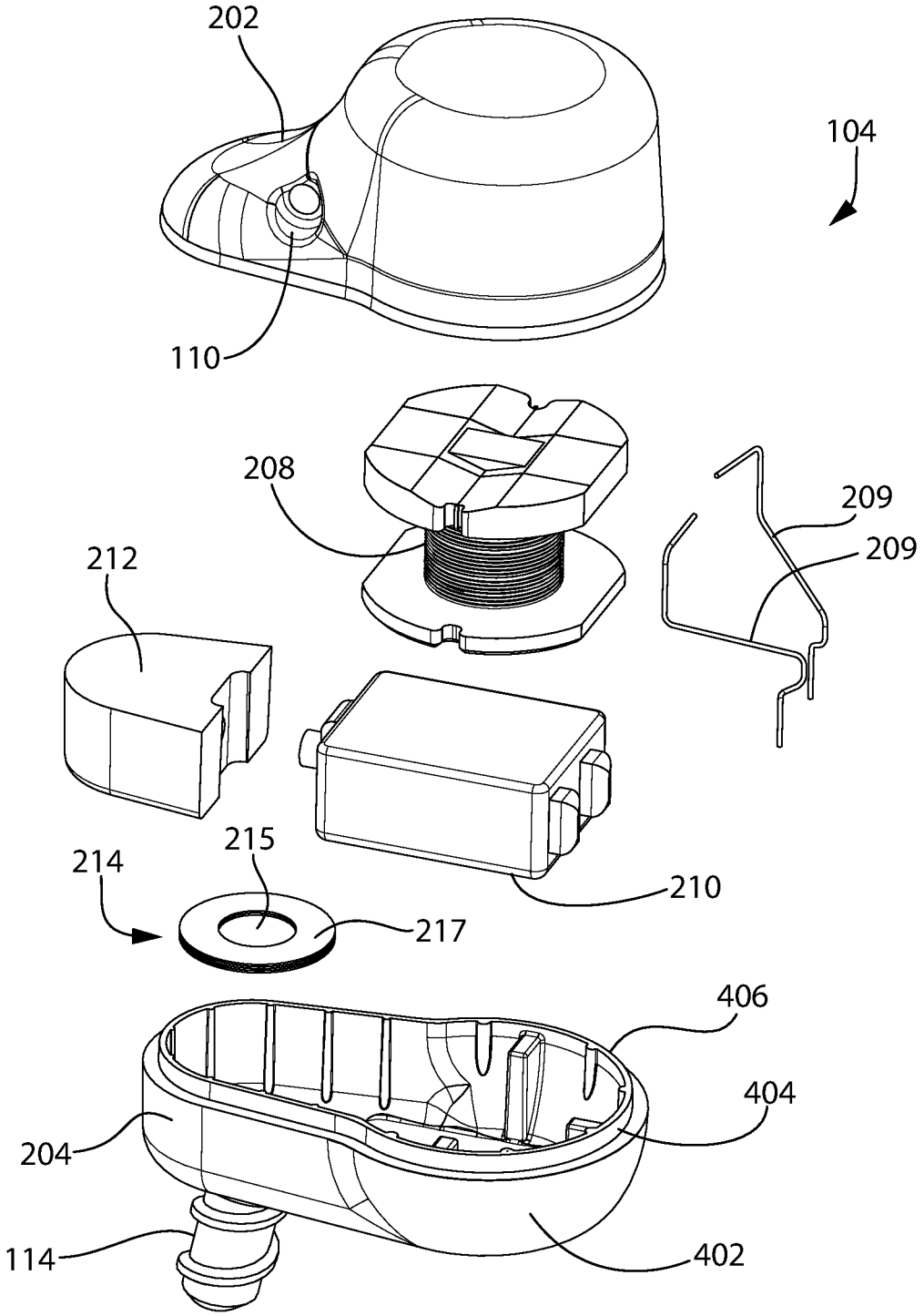
FIG. 4 is an exploded side perspective view of the earplug of FIG. 1.

Referring to FIGS. 2-4, the acoustic vent 214 may have a membrane 215 (shown in FIG. 3) shaped and dimensioned to fit an opening in the projection 114. By shaping and dimensioning the acoustic vent 214 to fit the opening in the projection 114, a waterproof seal is formed to prevent components of the earplug 104 (e.g., speaker 210, receive coil 208, and electrical audio signal wiring 209) from exposure to water while the earplug 104 is in use. Following the membrane 215, the sound channel 216 may be tapered into the channel of the inner lumen of the projection 114. In one embodiment, the sound channel 216 between the membrane 215 and the inner lumen of the projection 114 may be frustoconical in shape.

The membrane 215 of the acoustic vent 214 may be acoustically transmissive with a minimal acoustic loss of less than about 2 dB when sound is transmitted through the acoustic vent 214. The membrane 215 of the acoustic vent 214 may prevent water from passing through the membrane. The membrane may be comprised of polytetrafluoroethylene (PTFE) or other waterproof and/or water resistant materials that provide a similar acoustical transmissivity. In one embodiment, the membrane 215 is comprised of expanded polytetrafluoroethylene (ePTFE). In one embodiment, the membrane 215 is comprised of a non-woven material. In one embodiment, the ePTFE structure is comprised of nodes, fibrils and pores, which may be configured to facilitate the transmission of air and sound to the user's ear, while repelling fluid and other particulates. In one embodiment, the membrane 215 repels water to protect the earplug 104 against immersion up to at least IP68 standards. In one embodiment, the entire earplug 104 is waterproof against immersion up to at least IP68 standards.

The membrane 215 of the acoustic vent 214 may have a circular shape to fit an opening in the projection 114 (shown in FIG. 2). The membrane 215 of the acoustic vent 214 may have a diameter between approximately 4 mm to approximately 6 mm. The membrane 215 of the acoustic vent 214 may have a diameter less than 4 mm. The membrane 215 of the acoustic vent 214 may have a diameter greater than 6 mm. The membrane 215 of the acoustic vent 214 may have a thickness of about 0.28 mm to about 0.36 mm.

The acoustic vent 214 may have an outer flange portion 217 friction fit between the sound path seal 212 and the bottom housing 204 to maintain a stationary position in the earplug 104. In another embodiment, an adhesive may be applied to a first side of the outer flange portion 217 of the acoustic vent 214 to adhere the acoustic vent 214 to bottom housing 204. The use of a friction fit or an adhesive may permit the acoustic vent 214 to maintain a stationary position in the earplug 104. The outer flange portion 217 of the acoustic vent 214 may have a width of about 0.059 inches. The outer flange portion 217 of the acoustic vent 214 may have a width of less than 0.059 inches. The outer flange portion 217 of the acoustic vent 214 may have a width of greater than 0.059 inches.

The bottom housing 204 may include a side surface 402 and a top surface 404. A ridge 406 may extend perpendicularly from the top surface 404. The ridge 406 may extend around a perimeter of the top surface 404. When contacted by the top housing 202, the ridge 406 may couple the bottom housing 204 to the top housing 202 to form a waterproof seal and prevent water from entering the inner compartment.

Turning back to FIG. 2, projection 114 may be configured to receive the sound from the speaker 210 via the sound channel 216 and output the audible sound 108 to the ear of the user. The projection 114 may extend from the bottom housing 204 at an angle A to provide a contour to the ear of the user for an ergonomic fit during use. Angle A may be an angle of the axis C of the projection 114 relative to an axis B that is orthogonal to a bottom wall 220 of the bottom housing 204. In some embodiments, the angle A of the projection 114 is an angle between 5 degrees and 20 degrees or an angle between 10 degrees and 15 degrees; or in one embodiment an angle of approximately 12 degrees. In one embodiment, the projection 114 is generally cylindrical. In one embodiment, the projection 114 is not limited to a cylindrical geometry. In one embodiment, the length of the projection is 0.224 inches. In one embodiment, the length of the projection is greater than 0.224 inches. In one embodiment, the length of the projection is less than 0.224 inches. In one embodiment, the inner diameter of the projection is 0.065 inches and the outer diameter is 0.115 inches. In one embodiment, the inner diameter of the projection is less than 0.065 inches and the outer diameter is less than 0.115 inches. In one embodiment, the inner diameter of the projection is greater than 0.065 inches and the outer diameter is greater than 0.115 inches. In other embodiments, the projection 114 may be frustoconical in shape. In one embodiment, the length of the projection 114 is greater than the diameter of the projection 114. The projection 114 may include threading 224 to secure the earplug padding 502 (which may also be referred to herein as an "earplug tip") (see FIG. 5). The projection 114 may also include a tapered end 223. The tapered end 223 may allow the earplug padding 502 to be easily installed. In one embodiment, the projection 114 is tapered from a proximal end to a distal end. In one embodiment, the projection 114 tapers toward the distal end. In one embodiment, the projection 114 has an open distal end. In one embodiment, the projection 114 has at least one barrier at the distal end.

Figure 5:
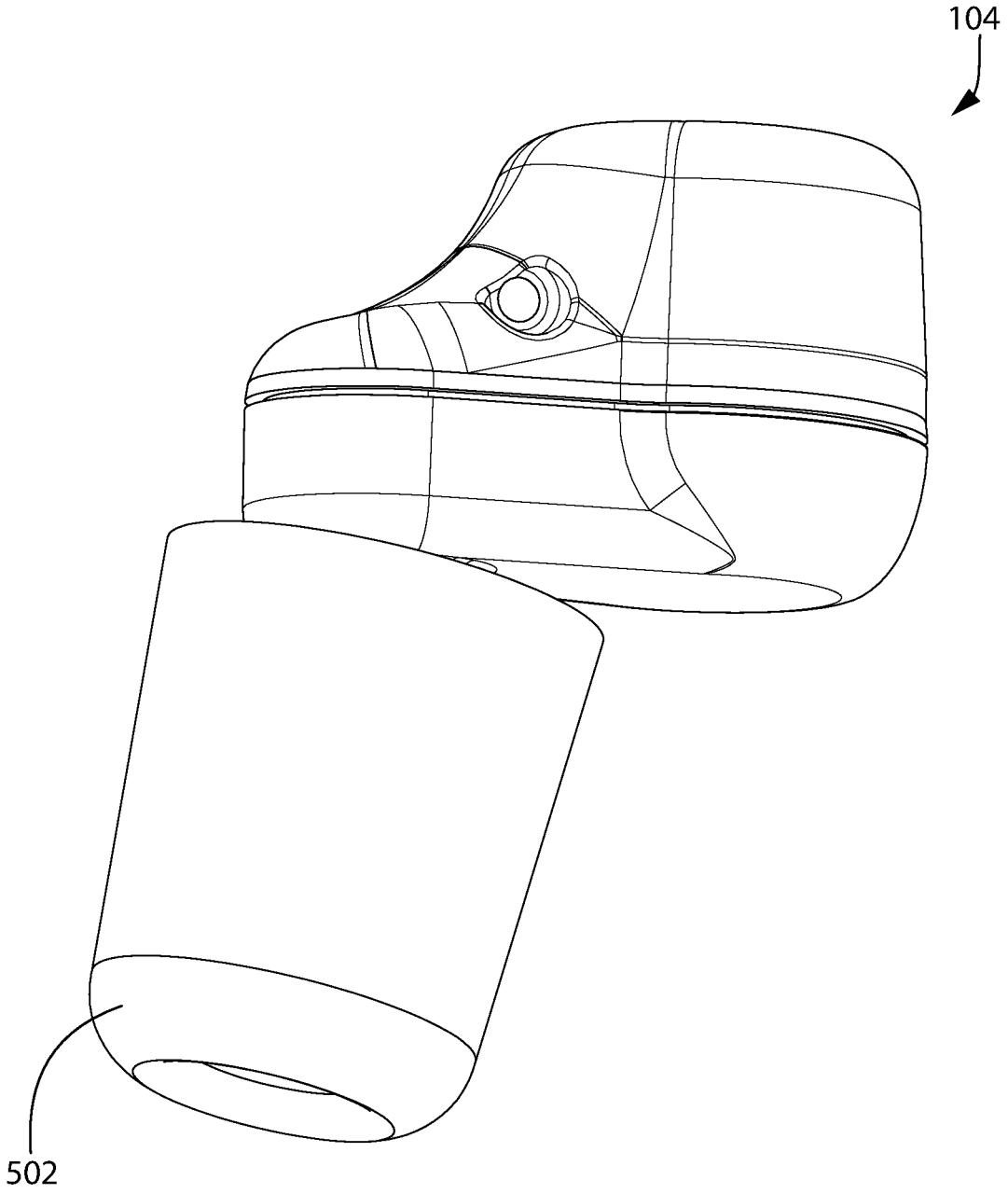
FIG. 5 is a perspective side view of the earplug of FIG. 1.

Referring to FIGS. 2 and 5, the earplug padding 502 may be provided for comfort and sealing the earplug 104 within the user's ear canal. The earplug padding 502 may be configured to adapt to the contour of the user's ear. The earplug padding 502 may be dimensioned to fit into a user's ear to form a sound-proof barrier, configured to minimize or eliminate external sound from entering the user's ear canal. In one embodiment, the earplug padding 502 is an earplug seal. In one embodiment, the earplug padding 502 has an open distal end. In one embodiment, earplug padding 502 has at least one barrier at the distal end. The earplug padding 502 may be tapered from a proximal end to a distal end. In one embodiment, the earplug padding 502 tapers toward the distal end. The earplug padding 502 may be in direct contact with the contour of the user's ear. The earplug padding 502 may be disposable and replaceable with a new earplug padding 502 as preferred for hygiene purposes or for a desired size, shape, and feel. In some embodiments, the earplug padding 502 may have a frustoconical shape. The earplug padding 502 may comprise a soft, flexible material, such as foam. The earplug padding 502 may comprise a rubber material. The length of the earplug padding 502 may be greater than the diameter of the earplug padding. The earplug padding 502 may comprise of a curved tip. The earplug padding 502 may comprise a soft, flexible material, which mimics the properties of foam. The earplug padding 502 may comprise of a compliant, elastomeric and/or deformable material. The earplug padding 502 may be comprised of memory foam. In one embodiment, the earplug padding 502 is comprised of a polyurethane foam.

The earplug padding 502 may be attached to the projection 114. For example, in some embodiments, the earplug padding 502 may screw onto and off of projection 114 to allow for replacement of the earplug padding 502. In some embodiments, the earplug padding 502 may be friction fit onto projection 114 without threading. In other embodiments, the earplug padding 502 is more permanently secured to the projection 114 such as by the use of an adhesive. In some embodiments, such as the embodiment shown in FIG. 8 and described in further detail below, the earplug padding 502 may include a flange-type shape.

Figure 6:
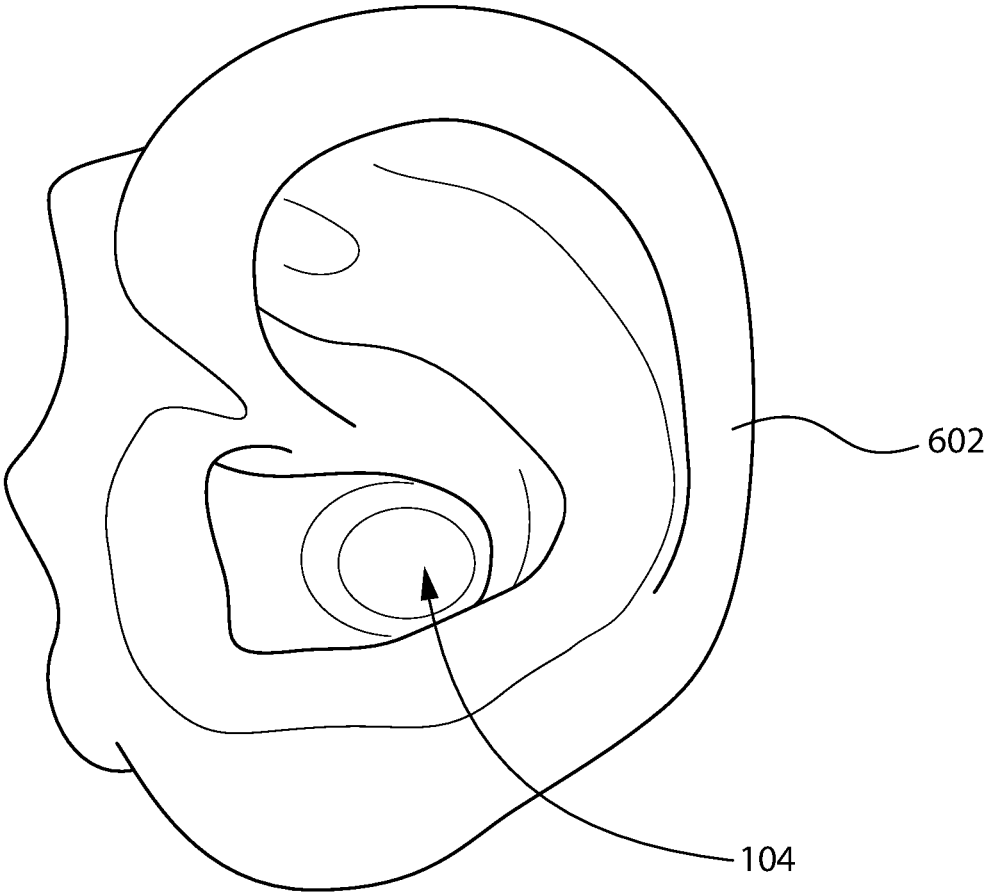
FIG. 6 is a view of the earplug of FIG. 1, inserted into the ear.

Referring to FIG. 6, earplug 104 is shown as positioned inside an ear 602 of the user. In some embodiments, the earplug 104 is waterproof. In one embodiment, the earplug 104 is capable of producing sound in the ear 602 of the user even if the earplug 104 has been exposed to water or moisture from immersion or sweat of the user. In some embodiments, earplug 104 may be positioned inside ear 602 without the projection 114 contacting ear 602. In another embodiment, earplug 104 may be positioned inside ear 602 while contacting ear 602. In one embodiment, earplug 104 is positioned inside ear 602 such that earplug 104 is not visible. In one embodiment, earplug 602 is positioned inside ear 602 such that earplug 104 is visible. The housing 112 of earplug 104 may rest against the concha of ear 602 while the projection 114 is angled to extend into the ear canal of ear 602. In some embodiments the housing 112 is limited to the concha of ear 602.

Figure 7:
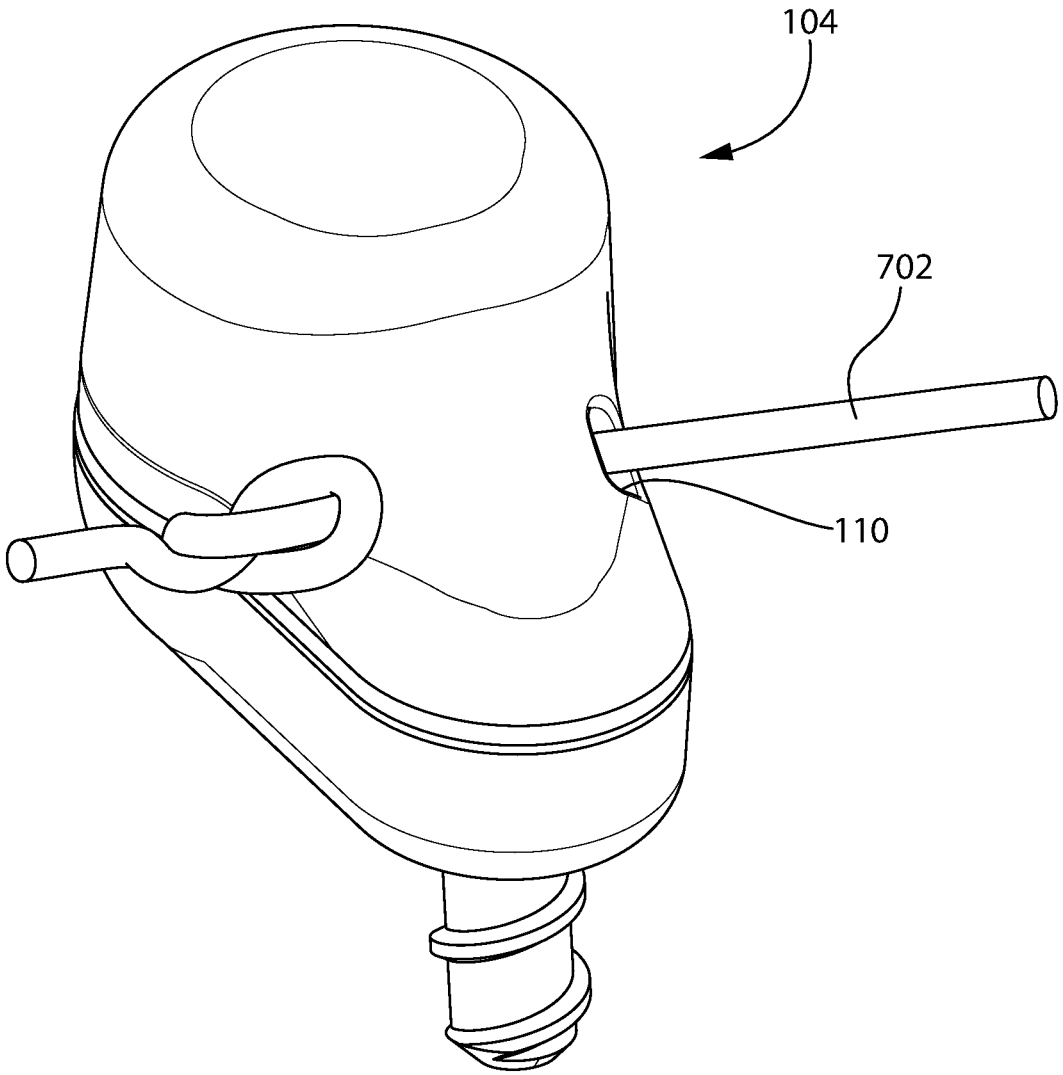
FIG. 7 is perspective view of the earplug of FIG. 1 illustrating the retention strap.

Referring to FIGS. 1 and 7, the earplug 104 may include an attachment feature 110. In some embodiments, the attachment feature 110 may be configured to attach to a retention device such as a lanyard 702 so that the earplug 104 can remain coupled to the user while the earplug 104 is not being used. In one embodiment, the attachment feature 110 is a through hole that extends entirely through a portion of the housing 112. The through hole may extend through the portion of the housing 112 along an axis D perpendicular to an axis C of the projection 114. In one embodiment, the through hole intersects the axis C of the projection 114.

The retention strap 702 may attach to the attachment feature 110 so that the earplug 104 can remain coupled to the user while the earplug 104 is not being used. As shown in FIG. 7, retention strap 702 may be threaded through a through hole of attachment feature 110. For example, retention strap 702 may be inserted into, and pushed through, one end of the through hole until the retention strap 702 exits the through hole at the other end. The retention strap 702 may be pulled to secure the retention strap 702 in place. The earplug 104 may be tied to other earplugs via the retention strap 702 with the retention strap 702 extending behind the user's head during use. Alternatively, the retention strap 702 may be attached to a headset or user's clothing during use.

Figure 8:
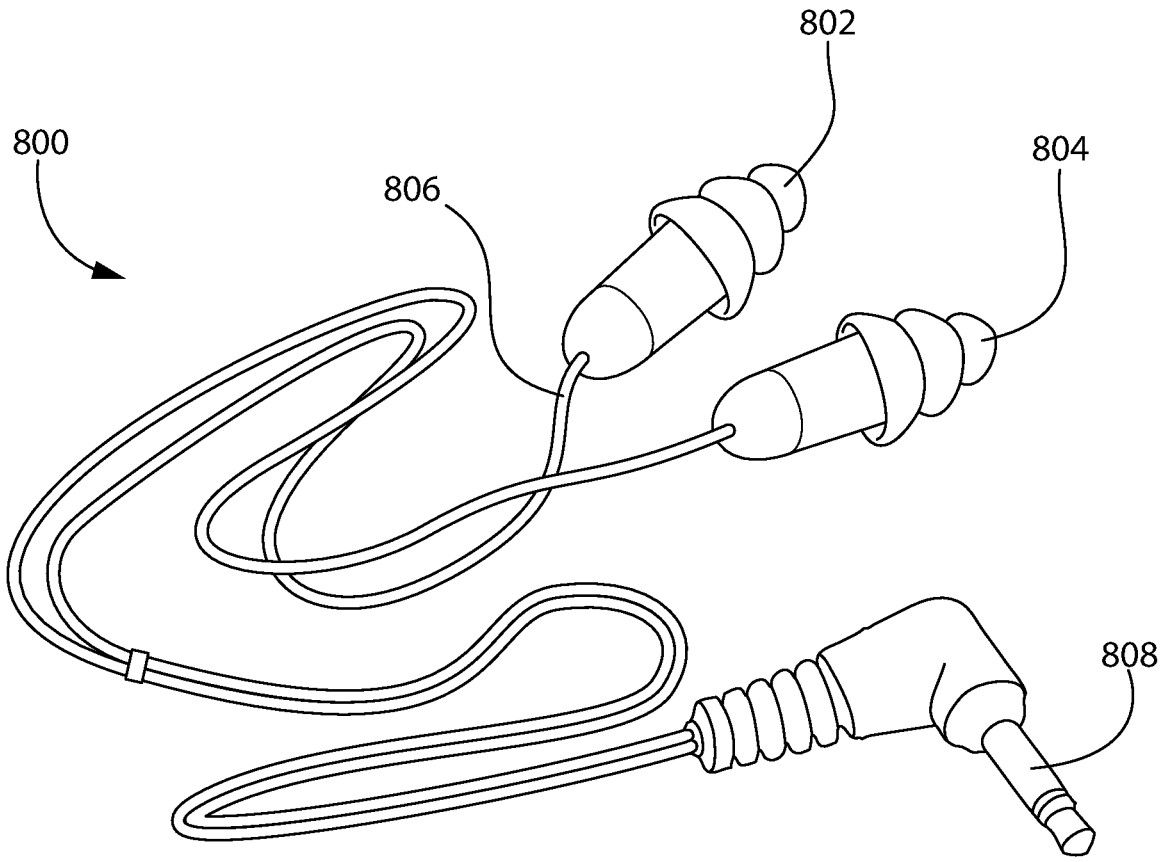
FIG. 8 is a side view of a flange-style earplug embodiment.

Referring to FIG. 8, a flange style earplug 800 is shown as an exemplary embodiment of the earplug 104. The flange style earplug 800 may include left flange earplug 802, right flange earplug 804, and electrical connector 808 that can form a wired connection to audio source 102. A wire 806 may connect the left flange earplug 802 and right flange earplug 804 to the electrical connector 808. In one embodiment, the flange style earplug 800 may be wireless such that wire 806 and electrical connector 808 are removed and the left flange earplug 802 and right flange earplug 804 are wirelessly coupled to the audio source 102. In one embodiment, the left flange earplug 802 and right flange earplug 804 have a repetitive frustoconical shape.

It will be appreciated by those skilled in the art that changes could be made to the exemplary embodiments shown and described above without departing from the broad inventive concept thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention, different components as opposed to those specifically mentioned may perform at least some of the features described herein, and features of the disclosed embodiments may be combined. As used herein, the term "about" may refer to + or −10% of the value referenced. For example, "about 9" is understood to encompass 8.1 and 9.9.

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

It will be understood that, although the terms "first," "second," etc. are sometimes used herein to describe various elements, these elements should not be limited by these terms. These terms are only used to distinguish one element from another. For example, a first element could be termed a second element, and, similarly, a second element could be termed a first element, without changing the meaning of the description, so long as all occurrences of the "first element" are renamed consistently and all occurrences of the second element are renamed consistently. The first element and the second element are both elements, but they are not the same element.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, operations, elements, and/or components, but do not preclude the presence or addition of one or more other features, integers, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

Further, to the extent that the method does not rely on the particular order of steps set forth herein, the particular order of the steps should not be construed as limitation on the claims. The claims directed to the method of the present invention should not be limited to the performance of their steps in the order written, and one skilled in the art can readily appreciate that the steps may be varied and still remain within the spirit and scope of the present invention.

What is claimed is:

1. An earplug comprising:

a housing;

a receiver positioned in the housing, the receiver being configured to receive a wireless audio signal from an audio source external to the earplug and convert the wireless audio signal to an electrical audio signal;

a speaker positioned in the housing, the speaker being configured to receive the electrical audio signal from the receiver and convert the electrical audio signal into audible sound output from a speaker port of the speaker;

a projection extending from the housing, the projection including an opening that defines at least a portion of a sound channel from the speaker, the projection being configured to receive the audible sound output from the speaker and output the audible sound out of the earplug;

an earplug padding extending over the projection and configured to form a seal with a user's ear canal; and an acoustic vent positioned in the sound channel, the acoustic vent being acoustically transmissive, the acoustic vent including a waterproof membrane extending across the sound channel, wherein the sound channel includes a first end proximate the speaker and a second end at a distal end of the projection, wherein the waterproof membrane is disposed within the sound channel between the first end and the second end, and wherein the waterproof membrane of the acoustic vent extends across the opening of the projection, forming a waterproof seal.

2. The earplug of claim 1, wherein the projection is oriented at a predetermined angle relative to a bottom surface of the housing.

3. The earplug of claim 2, wherein the predetermined angle is between 5 degrees and 20 degrees.

4. The earplug of claim 2, wherein the predetermined angle is between 10 degrees and 15 degrees.

5. The earplug of claim 2, wherein the predetermined angle is approximately 12 degrees.

6. The earplug of claim 1 further comprising:

a sound path seal that extends from the speaker to the acoustic vent, the sound path seal including an opening that defines at least a portion of the sound channel from the speaker.

7. The earplug of claim 6, wherein the sound path seal extends about a periphery of the speaker port to create a waterproof seal at the speaker.

8. The earplug of claim 1, wherein the receiver is a receiver coil.

9. The earplug of claim 1, wherein a length of the projection is greater than a diameter of the projection.

10. The earplug of claim 1, wherein the projection tapers toward the distal end of the projection.

11. The earplug of claim 1, wherein the waterproof membrane is comprised of polytetrafluoroethylene (PTFE) or expanded polytetrafluoroethylene (ePTFE).

12. The earplug of claim 1, wherein the earplug padding tapers toward a distal end of the earplug padding.

13. The earplug of claim 1, wherein a length of the earplug padding is greater than a diameter of the earplug padding.

14. The earplug of claim 1, wherein the earplug padding is comprised of a compliant, elastomeric and/or deformable material.

15. The earplug of claim 1, wherein the waterproof membrane repels water to protect the earplug against immersion up to at least IP68 standards.

16. An earplug comprising:

a housing;

a receiver positioned in the housing, the receiver being configured to receive a wireless audio signal from an audio source external to the earplug and convert the wireless audio signal to an electrical audio signal;

a speaker positioned in the housing, the speaker being configured to receive the electrical audio signal from the receiver and convert the electrical audio signal into audible sound output from a speaker port of the speaker;

a projection extending from the housing, the projection including an opening that defines at least a portion of a sound channel from the speaker, the projection being configured to receive the audible sound output from the speaker and output the audible sound out of the earplug, the projection oriented at a predetermined angle relative to a bottom surface of the housing, a length of the projection being greater than a diameter of the projection;

an earplug padding extending over the projection and configured to form a seal with a user's ear canal, a length of the earplug padding is greater than a diameter of the earplug padding, the earplug padding tapering toward distal end of the earplug padding;

an acoustic vent positioned in the sound channel, the acoustic vent being acoustically transmissive, the acoustic vent including a waterproof membrane to restrict water from contacting the speaker, the waterproof membrane of the acoustic vent extending across the opening of the projection, forming a waterproof seal; and a sound path seal extending from the speaker to the acoustic vent, the sound path seal including an opening that defines at least a portion of the sound channel from the speaker, the sound path seal extending about a periphery of the speaker port to create a waterproof seal at the speaker, wherein the sound channel includes a first end proximate the speaker and a second end at a distal end of the projection, and wherein the waterproof membrane is disposed within the sound channel between the first end and the second end.

17. The earplug of claim 1, the sound channel comprises a top portion and a bottom portion, wherein the top portion is disposed proximate the speaker and the bottom portion extends through the projection.

18. The earplug of claim 17, wherein the top portion of the sound channel is conical or frustoconical in shape and the bottom portion is frustoconical in shape, and wherein the waterproof membrane is positioned between the top portion of the sound channel and the bottom portion of the sound channel.

19. The earplug of claim 6, wherein the waterproof membrane is sandwiched between the housing and the sound path seal.

* * * * *